US012467390B2

(12) United States Patent
Raimondi et al.

(10) Patent No.: US 12,467,390 B2
(45) Date of Patent: Nov. 11, 2025

(54) OIL CIRCUIT AND SPOOL VALVE FOR SELECTIVE CONTROL OF VARIABLE VALVE LIFT SYSTEMS

(71) Applicant: Eaton Intelligent Power Limited, Dublin (IE)

(72) Inventors: Emanuele Raimondi, Turin (IT); Nicola Andrisani, Cumiana (IT); Alessandro Roscioli, Turin (IT); Marco Ravoni, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/970,245

(22) Filed: Dec. 5, 2024

(65) Prior Publication Data

US 2025/0092805 A1 Mar. 20, 2025

Related U.S. Application Data

(63) Continuation of application No. PCT/EP2023/025299, filed on Jun. 28, 2023.

(60) Provisional application No. 63/367,217, filed on Jun. 29, 2022.

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 2001/34426; F16K 11/07; F16K 11/0613; F15D 13/0402
See application file for complete search history.

(56) References Cited

U.S. PATENT DOCUMENTS

| | | | |
|---|---|---|---|
| 2008/0078342 A1 | 4/2008 | Hirayama | |
| 2011/0017156 A1 | 1/2011 | Smith | |
| 2019/0257257 A1 | 8/2019 | Bonkoski | |

FOREIGN PATENT DOCUMENTS

| | | | | |
|---|---|---|---|---|
| CN | 102066701 B | * | 6/2013 | ..... F01L 1/022 |
| CN | 107690509 B | | 9/2020 | |
| DE | 112014000742 T5 | * | 10/2015 | ..... F01L 1/3442 |
| WO | WO 2021199002 A1 | | 10/2021 | |

OTHER PUBLICATIONS

International search report and Written Opinion received for PCT Application No. PCT/EP23/25299, 10 pages, Oct. 2, 2023.

* cited by examiner

*Primary Examiner* — Ngoc T Nguyen
(74) *Attorney, Agent, or Firm* — Baker Botts L.L.P.

(57) ABSTRACT

A spool valve assembly operable for an automatic control of an oil flow, the spool valve assembly including an outer case, a spool valve configured to slide axially within the outer case, a first inlet port on the outer case configured for connecting with a first oil gallery, wherein the first oil gallery is operable as an outlet of a first oil control valve, a second inlet port on the outer case configured for connecting with a second oil gallery, wherein the second oil gallery is operable as an outlet of a second oil control valve, a spool outlet on the outer case configured for connecting with a third oil gallery, and a return spring configured to cause the spool valve to return to a rest position.

20 Claims, 14 Drawing Sheets

OIL CIRCUIT AND SPOOL VALVE FOR SELECTIVE CONTROL OF VARIABLE VALVE LIFT SYSTEMS

PRIORITY

This application is a continuation under 35 U.S.C. § 365(c) of International Patent Application No. PCT/EP2023/025299, filed on 28 Jun. 2023, which claims the benefit under 35 U.S.C. § 119(e) of U.S. Application No. 63/367,217, filed 29 Jun. 2022, all of which are incorporated herein by reference.

TECHNICAL FIELD

The present disclosure relates generally to mechanisms for supporting different modes for engines, and more particularly to mechanisms and assemblies that enable an engine to activate/deactivate these modes efficiently.

BACKGROUND 1.5 stroke engine brake system is a variable valve actuation (VVA) technology. When applied to the control of the exhaust valves, the system can satisfy the growing demand for increased braking power. The main features of the system include deactivating exhaust rocker and dedicated engine brake rocker. The engine brake and exhaust rocker lost motion mechanisms ensure the control of the dynamics when the system is deactivated. While in drive mode, the deactivating exhaust rocker behaves as a standard one. This is achieved by keeping the deactivating exhaust rocker in a latch state and thus, fully transmitting the exhaust cam lift to the valves. At the same time, the mechanical capsule housed in the engine brake rocker remains disengaged. As a result, the brake lift is inactive. When required, the electronic control unit (ECU) of the vehicle actuates the engine brake. While conventional engine brakes utilize only one compression release event. The 1.5 stroke engine brake has two per one revolution, increasing the braking performance by as much as 75%. In order to accomplish this, the main exhaust rocker must be deactivated. Disconnecting valves from the cam while the main exhaust event is inactive, the engine brake capsule is engaged. The system then transmits the brake lifts to the valve. This brake lift optimizes the amount of air in the cylinder at the beginning of each compression stroke and releases the compressed air. The 1.5 stroke engine brake system can be fitted with any single or dual overhead cam engine architecture. The system can result in up to a 75% increase in braking power at low speed.

Cylinder deactivation system is another VVA technology. The cylinder deactivation system is developed for medium and heavy-duty engines in response to the ever-increasing demand for cleaner and more efficient internal combustion engines. The main features of the system include a deactivating exhaust rocker and a deactivating intake rocker. The intake and exhaust rocker lost motion mechanisms are designed to ensure the full control of the system dynamics when in the deactivated state. While in drive mode, the deactivating mechanism is turned off and both intake and exhaust deactivating rockers behave as standard ones, fully transmitting the exhaust and intake cam lifts to the corresponding valves. When required, the ECU of the vehicle actuates the cylinder activation system. In this mode, both rockers get deactivated and no longer transfer the cam lift to the valves. As a result, the valves remain closed. The cylinder deactivation system can be fitted with any engine architecture.

SUMMARY OF PARTICULAR EMBODIMENTS

In particular embodiments, a spool valve assembly is disclosed that may be operable for an automatic control of an oil flow. The spool valve assembly may comprise an outer case. The spool valve assembly may also comprise a spool valve configured to slide axially within the outer case. The spool valve assembly may additionally comprise a first inlet port on the outer case configured for connecting with a first oil gallery and a second inlet port on the outer case configured for connecting with a second oil gallery. In particular embodiments, the first oil gallery may be operable as an outlet of a first oil control valve and the second oil gallery may be operable as an outlet of a second oil control valve. The spool valve assembly may additionally comprise a spool outlet on the outer case configured for connecting with a third oil gallery. The spool valve assembly may further comprise a return spring configured to cause the spool valve to return to a rest position.

In particular embodiments, which may combine the features of some or all above embodiments, a method of switching operations of an oil control circuit among a plurality of oil controlled variable valve lift modes is disclosed. The method may comprise deactivating a first and a second oil control valves associated with the oil control circuit. The deactivation of the first and second oil control valves may cause no oil flow in a first oil gallery and a second oil gallery. In particular embodiments, the first oil gallery may be operable as an outlet of the first oil control valve and the second oil gallery may be operable as an outlet of the second oil control valve. The first oil gallery may be connected with a first inlet port on an outer case of a spool valve assembly associated with the oil control circuit. The second oil gallery may be connected with a second inlet port on the outer case of the spool valve assembly. In particular embodiments, a third oil gallery may be connected with a spool outlet on the outer case of the spool valve assembly. A spool valve of the spool valve assembly may be configured to slide axially within the outer case of the spool valve assembly is at a rest position. The method may further comprise operating the oil control circuit in a first mode.

In particular embodiments of a method of switching operations of an oil control circuit among a plurality of oil controlled variable valve lift modes, which may combine the features of some or all above embodiments, oil flow may be passable between the second oil gallery and the third oil gallery based on balancing pressure associated with the spool valve assembly between the second and third oil galleries.

In particular embodiments of a method of switching operations of an oil control circuit among a plurality of oil controlled variable valve lift modes, which may combine the features of some or all above embodiments, the first mode may be a drive mode. In particular embodiments, the oil control circuit may be associated with an engine brake. The engine brake may be off. The oil control circuit may be also associated with an exhaust valve for cylinder deactivation. The exhaust valve may be off. The oil control circuit may be additionally associated with an intake valve for cylinder deactivation. The intake valve may be off.

In particular embodiments of a method of switching operations of an oil control circuit among a plurality of oil controlled variable valve lift modes, which may combine the features of some or all above embodiments, the method may further comprise activating the second oil control valve. In particular embodiments, the activation of the second oil control valve may cause oil flow through the second oil gallery. The second oil gallery may pass the oil flow to the third oil gallery. The method may further comprise operating the oil control circuit in a second mode.

In particular embodiments of a method of switching operations of an oil control circuit among a plurality of oil controlled variable valve lift modes, which may combine the features of some or all above embodiments, the second mode may be a cylinder deactivation (CDA) mode. In particular embodiments, the oil control circuit may be associated with an engine brake. The engine brake may be off. The oil control circuit may be also associated with an exhaust valve for cylinder deactivation. The exhaust valve may be on. The oil control circuit may be additionally associated with an intake valve for cylinder deactivation. The intake valve may be on.

In particular embodiments of a method of switching operations of an oil control circuit among a plurality of oil controlled variable valve lift modes, which may combine the features of some or all above embodiments, the third mode may be an engine brake mode. In particular embodiments, the oil control circuit may be associated with an engine brake. The engine brake may be on. The oil control circuit may be also associated with an exhaust valve for cylinder deactivation. The exhaust valve may be on. The oil control circuit may be additionally associated with an intake valve for cylinder deactivation. The intake valve may be off.

In particular embodiments of a method of switching operations of an oil control circuit among a plurality of oil controlled variable valve lift modes, which may combine the features of some or all above embodiments, the method may further comprise activating the first oil control valve and the second oil control valve. The activation of the first oil control valve may cause oil flow through the first oil gallery and the activation of the second oil control valve may cause oil flow through the third oil gallery. One or more of the first oil gallery or the third oil gallery may pass the oil flow to the third oil gallery. The method may further comprise operating the oil control circuit in a fourth mode.

In particular embodiments of a method of switching operations of an oil control circuit among a plurality of oil controlled variable valve lift modes, which may combine the features of some or all above embodiments, the fourth mode may be an all-active mode. In particular embodiments, the oil control circuit may be associated with an engine brake. The engine brake may be on. The oil control circuit may be also associated with an exhaust valve for cylinder deactivation. The exhaust valve may be on. The oil control circuit may be additionally associated with an intake valve for cylinder deactivation. The intake valve may be on.

In particular embodiments, which may combine the features of some or all above embodiments, an oil control circuit configured for switching among a plurality of oil controlled variable valve lift modes is disclosed. The oil control circuit may comprise a first oil control valve, a second oil control valve, a first oil gallery operable as an outlet of the first oil control valve, a second oil gallery operable as an outlet of the second oil control valve, a third oil gallery, and a spool valve assembly. In particular embodiments, the spool valve assembly may comprise an outer case, a spool valve configured to slide axially within the outer case, a first inlet port on the outer case configured for connecting with the first oil gallery, a second inlet port on the outer case configured for connecting with the second oil gallery, a spool outlet on the outer case configured for connecting with the third oil gallery, and a return spring configured to cause the spool valve to return to a rest position.

In particular embodiments of an oil control circuit configured for switching among a plurality of oil controlled variable valve lift modes, which may combine the features of some or all above embodiments, the oil control circuit may be further configured for deactivating the first and the second oil control valves. The deactivation of the first and second oil control valves may cause no oil flow in the first oil gallery and the second oil gallery. The oil control circuit may be further configured for operating in a first mode.

In particular embodiments of an oil control circuit configured for switching among a plurality of oil controlled variable valve lift modes, which may combine the features of some or all above embodiments, oil flow may be passable between the second oil gallery and the third oil gallery based on balancing pressure associated with the spool valve assembly between the second and third oil galleries.

In particular embodiments of an oil control circuit configured for switching among a plurality of oil controlled variable valve lift modes, which may combine the features of some or all above embodiments, the first mode may be a drive mode. In particular embodiments, the oil control circuit may be associated with an engine brake. The engine brake may be off. The oil control circuit may be also associated with an exhaust valve for cylinder deactivation. The exhaust valve may be off. The oil control circuit may be additionally associated with an intake valve for cylinder deactivation. The intake valve may be off.

In particular embodiments of an oil control circuit configured for switching among a plurality of oil controlled variable valve lift modes, which may combine the features of some or all above embodiments, the oil control circuit may be further configured for deactivating the first oil control valve. The deactivation of the first oil control valve may cause no oil flow in the first oil gallery. The oil control circuit may be further configured for activating the second oil control valve. The activation of the second oil control valve may cause oil flow through the second oil gallery. In particular embodiments, the second oil gallery may pass the oil flow to the third oil gallery. The oil control circuit may be further configured for operating in a second mode.

In particular embodiments of an oil control circuit configured for switching among a plurality of oil controlled variable valve lift modes, which may combine the features of some or all above embodiments, the second mode may be a cylinder deactivation (CDA) mode. In particular embodiments, the oil control circuit may be associated with an engine brake. The engine brake may be off. The oil control circuit may be associated with an exhaust valve for cylinder deactivation. The exhaust valve may be on. The oil control circuit may be associated with an intake valve for cylinder deactivation. The intake valve may be on.

In particular embodiments of an oil control circuit configured for switching among a plurality of oil controlled variable valve lift modes, which may combine the features of some or all above embodiments, the oil control circuit may be further configured for activating the first oil control valve. The activation of the first oil control valve may cause oil flow through the first oil gallery. In particular embodiments, the oil flow through the first oil gallery may pressure the spool valve to slide axially within the outer case to a non-rest position. The spool valve sliding to the non-rest position may allow the oil flow through the first oil gallery to pass through the third oil gallery. The oil control circuit may be further configured for deactivating the second oil control valve. The deactivation of the second oil control valve may cause no oil flow in the second oil gallery. The oil control circuit may be further configured for operating in a third mode.

In particular embodiments of an oil control circuit configured for switching among a plurality of oil controlled variable valve lift modes, which may combine the features of some or all above embodiments, the third mode may be an engine brake mode. In particular embodiments, the oil control circuit may be associated with an engine brake. The engine brake may be on. The oil control circuit may be also associated with an exhaust valve for cylinder deactivation. The exhaust valve may be on. The oil control circuit may be additionally associated with an intake valve for cylinder deactivation. The intake valve may be off.

In particular embodiments of an oil control circuit configured for switching among a plurality of oil controlled variable valve lift modes, which may combine the features of some or all above embodiments, the oil control circuit may be further configured for activating the first oil control valve and the second oil control valve. The activation of the first oil control valve may cause oil flow through the first oil gallery and the activation of the second oil control valve may cause oil flow through the third oil gallery. One or more of the first oil gallery or the third oil gallery may pass the oil flow to the third oil gallery. The oil control circuit may be further configured for operating in a fourth mode.

In particular embodiments of an oil control circuit configured for switching among a plurality of oil controlled variable valve lift modes, which may combine the features of some or all above embodiments, the fourth mode may be an all-active mode. In particular embodiments, the oil control circuit may be associated with an engine brake. The engine brake may be on. The oil control circuit may be also associated with an exhaust valve for cylinder deactivation. The exhaust valve may be on. The oil control circuit may be additionally associated with an intake valve for cylinder deactivation. The intake valve may be on.

BRIEF DESCRIPTION OF THE DRAWINGS

The present invention will be described in greater detail below based on the exemplary figures. The invention is not limited to the exemplary embodiments. Other features and advantages of various embodiments of the present invention will become apparent by reading the following detailed description with reference to the attached drawings which illustrate the following.

Figure 1A:
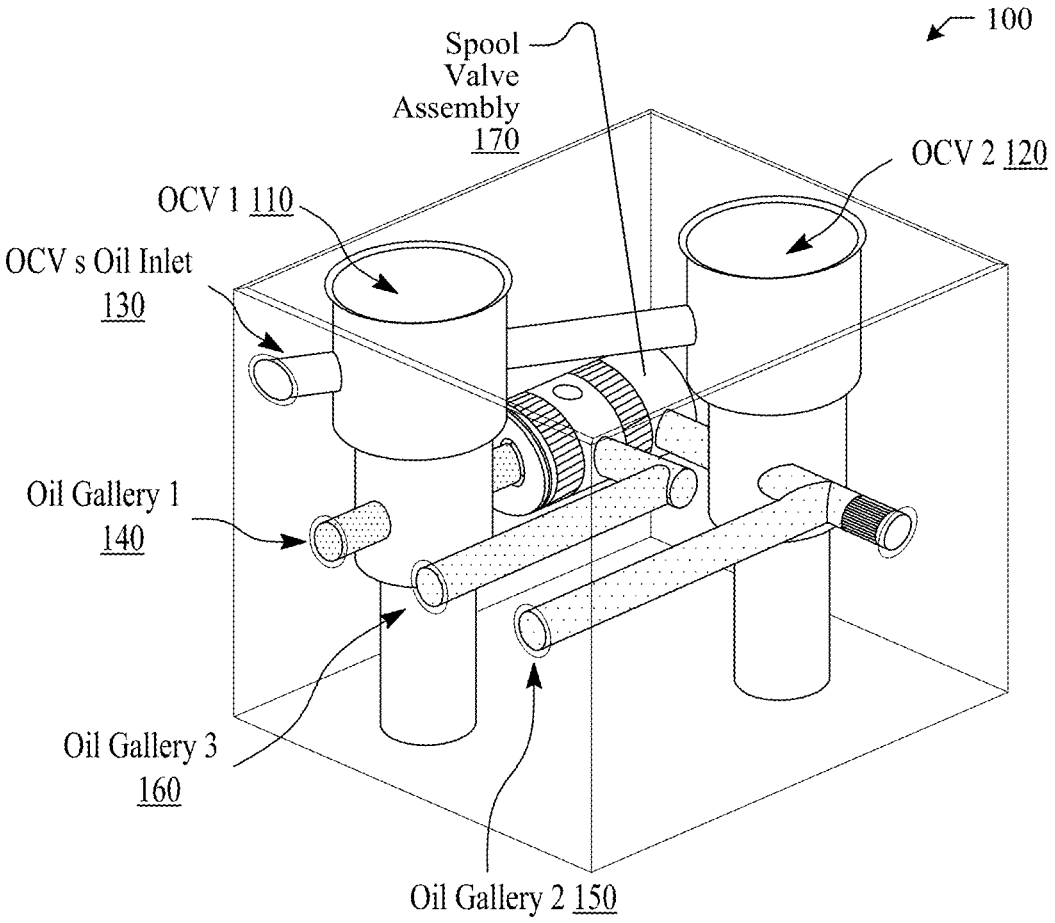
FIG. 1A illustrates a schematic perspective view of the oil control circuit.

It should be noted that figures provided may be illustrated schematically rather than literally or precisely; components and aspects of the figures may also not necessarily be to scale. Moreover, while like reference numerals may designate corresponding parts throughout the different views in many cases, like parts may not always be provided with like reference numerals in each view.

DESCRIPTION OF EXAMPLE EMBODIMENTS

In accordance with various embodiments of the present disclosure, a spool valve assembly and an oil control circuit and related mechanisms, devices, and methodologies are provided herein. For clarity, not all features of each actual implementation or embodiment may be described in this specification. Additionally, some aspects and features may be described at a high level. Further, features and aspects that are disclosed, illustrated, and/or apparently otherwise contemplated in certain specific configurations are fully contemplated to be mixed or combined to produce any and all resulting configurations using features and aspects from any embodiments and/or configurations considered herein. Thus, modifications, variations, adaptations, and/or combinations of features and aspects may be made that result in embodiments that are fully contemplated to fall within the scope of this disclosure.

Variable valve lift ("VVL") systems may permit switching between nominal, early, late, valve opening or closing. As a result, lift heights and durations may be controlled. The embodiments disclosed herein discloses an oil control circuit for VVL systems. In particular embodiments, the oil control circuit may comprise a spool valve assembly. The spool valve assembly may enable an automatic control of the oil flow according to the open or closed status of the oil control valves ("OCV") as disclosed herein.

In particular embodiments, engine braking (EB), cylinder deactivation (CDA), late intake valve closing (LIVC), late intake valve opening (LIVO), among many options may be hereby enabled. Complex combinations of the VVL options may also be enabled via the oil control circuit. Instead of increasing the number of oil control valves to be one for each function, it may be possible to reduce the number of oil control valves.

Traditional oil control circuit may use three oil control valves, each controlling a specific oil gallery. With the three oil control valves, the oil control circuit may permit selective control of the flow in each of them. By contrast, the oil control circuit disclosed herein may comprise two oil control valves.

FIG. 1A illustrates a schematic perspective view of the oil control circuit 100. In particular embodiments, the oil control circuit 100 may comprise a first oil control valve 110 and a second oil control valve 120. The first oil control valve 110 and the second oil control valve 120 may receive oil from an inlet gallery 130. The oil control circuit 100 may additionally comprise a first oil gallery 140, a second oil gallery 150, and a third oil gallery 160. The oil control circuit 100 may further comprise a spool valve assembly 170. The spool valve assembly 170 may be integrated downstream of the first oil control valve 110 and the second oil control valve 120.

Figure 1B:
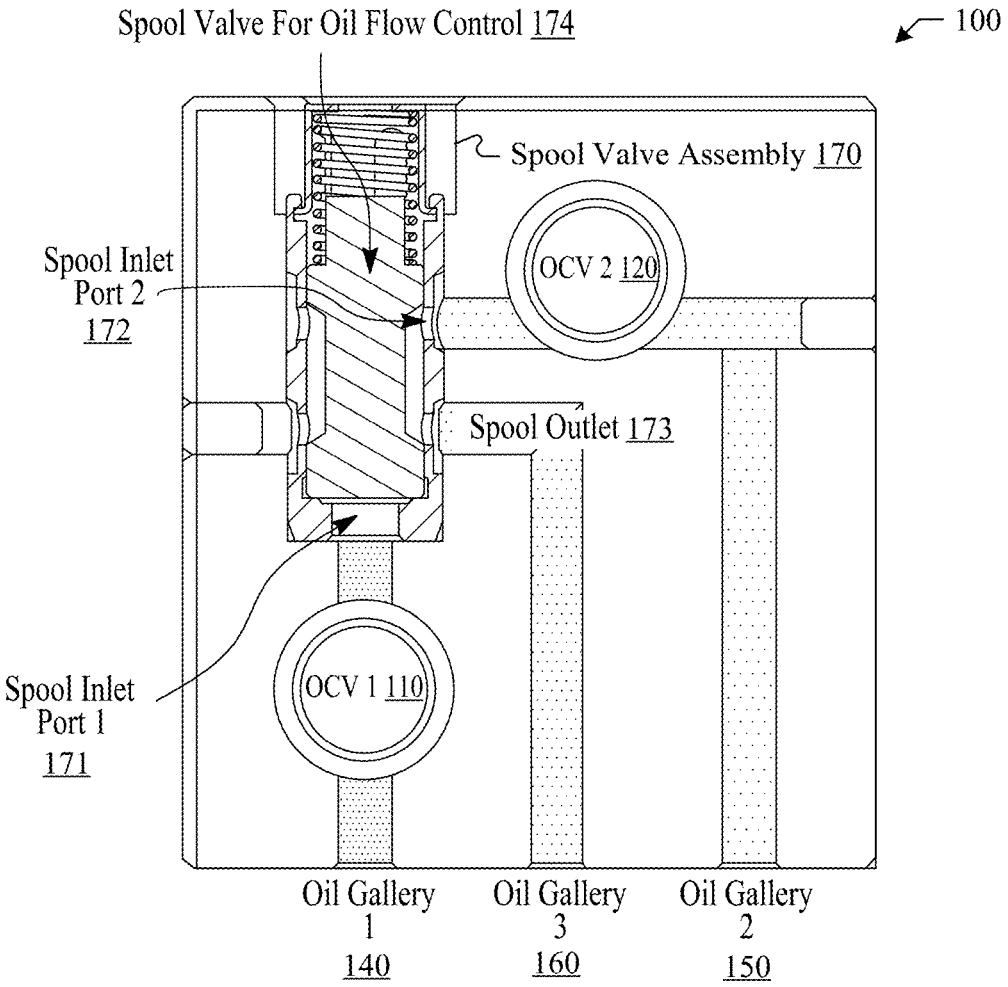
FIG. 1B illustrates a schematic partial sectional top view of the oil control circuit.

FIG. 1B illustrates a schematic partial sectional top view of the oil control circuit 100. In particular embodiments, the spool valve assembly 170 may have two inlet ports on the outer case. In particular embodiments, the first inlet port 171 may be between a spool valve 174 and the first oil control valve 110 whereas the second inlet port 172 may be between the spool valve 174 and the second oil control valve 120. In particular embodiments, the first inlet port 171 may be connected with the first oil gallery 140 and the second inlet port 172 may be connected with the second oil gallery 150. The third oil gallery 160 may be the outlet of the first oil control valve 110. The second oil gallery 150 may be the outlet of the second oil control valve 120. In particular embodiments, the spool valve assembly 170 may comprise an outlet 173 on the outer case. The outlet 173 may be connected with the third oil gallery 160.

Figure 2A:
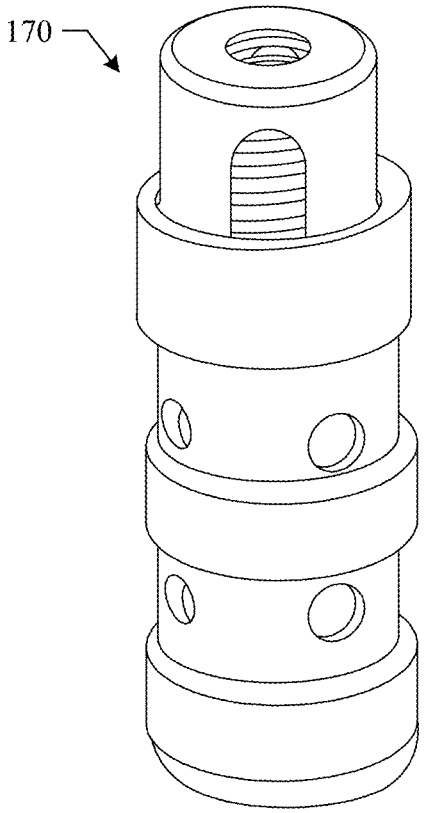
FIG. 2A illustrates a schematic view of the spool valve assembly.
Figure 2B:
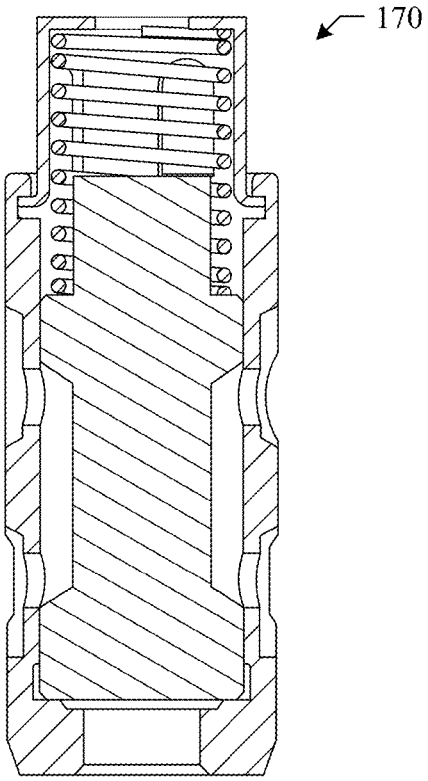
FIG. 2B illustrates a schematic partial sectional view of the spool valve assembly.

FIG. 2A illustrates a schematic view of the spool valve assembly 170. FIG. 2B illustrates a schematic partial sectional view of the spool valve assembly 170. In particular embodiments, the spool valve assembly 170 may comprise a spool valve 174. The spool valve 174 may normally close the first inlet port 171 to the first oil gallery 140 and maintain opened connection between the second oil gallery 150 and the third oil gallery 160. In particular embodiments, the spool valve assembly 170 may further comprise a spool return spring 175. The return spring 175 may be set in order to open when pressure on the first oil gallery 140 overcomes a specific value, permitting the spool valve 174 to slide axially within the outer case. The sliding of the spool valve 174 may result in the connection between the first oil gallery 140 and the third oil gallery 160. At the same time, the connection between the second oil gallery 150 and the third oil gallery 160 may be closed.

Figure 3:
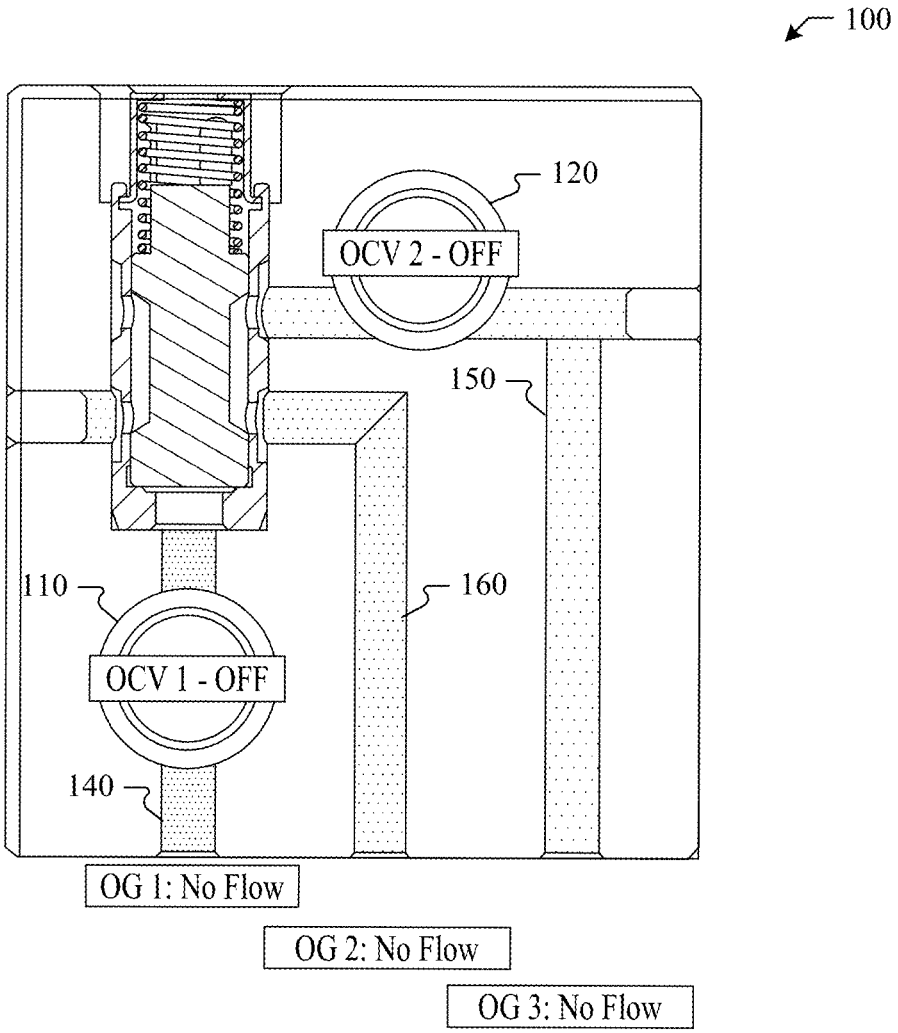
FIG. 3 illustrates a schematic partial sectional top view of the oil control circuit operating in a first mode.

FIG. 3 illustrates a schematic partial sectional top view of the oil control circuit 100 operating in a first mode. In particular embodiments, the oil control circuit 100 may operate in four different modes. The first mode may be the default status when the first oil control valve 110 and the second oil control valve 120 are both off. In this mode, there may be no oil flow passing for all the three oil galleries. The second oil gallery 150 and the third oil gallery 160 may be connected through the spool valve balancing pressure between the two galleries.

Figure 4:
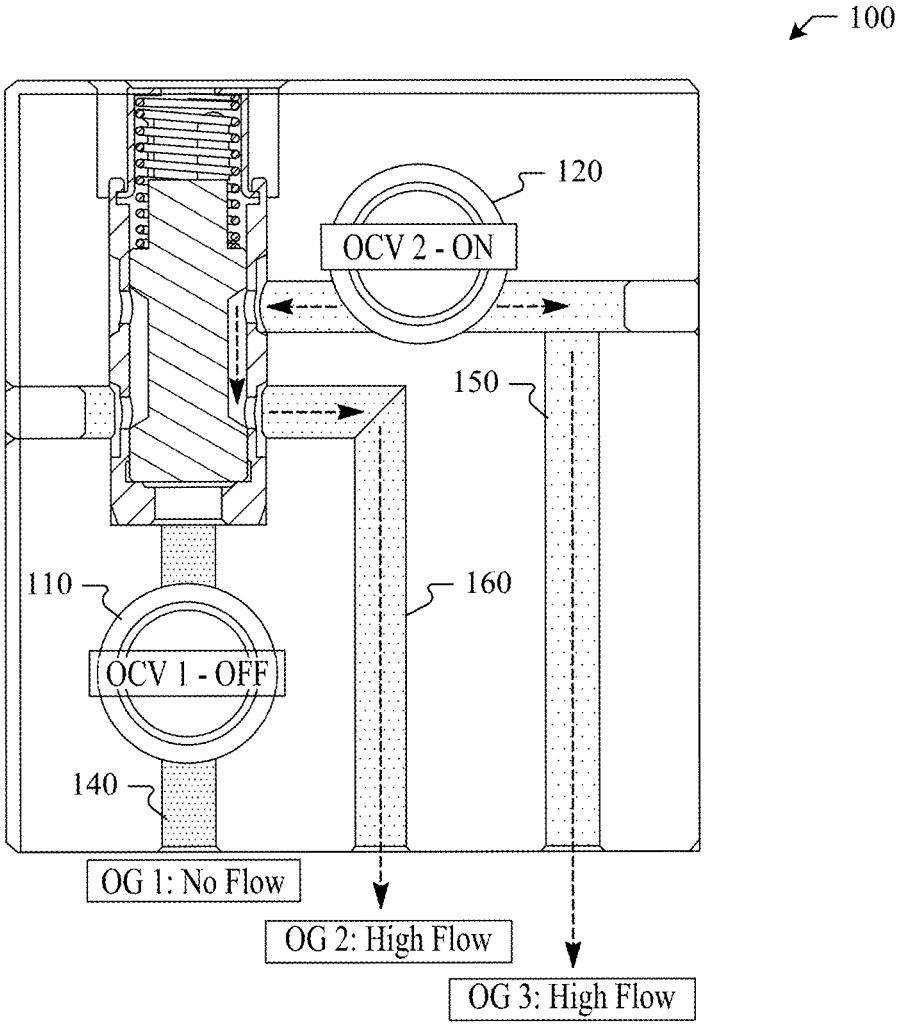
FIG. 4 illustrates a schematic partial sectional top view of the oil control circuit operating in a second mode.

FIG. 4 illustrates a schematic partial sectional top view of the oil control circuit 100 operating in a second mode. From the default status (i.e., the first mode), the second oil control valve 120 may be activated. The activation of the second oil control valve 120 may bring oil to the second oil gallery 150 and the third oil gallery 160 that are already in connection. There may be oil flow in the first oil gallery 140.

Figure 5:
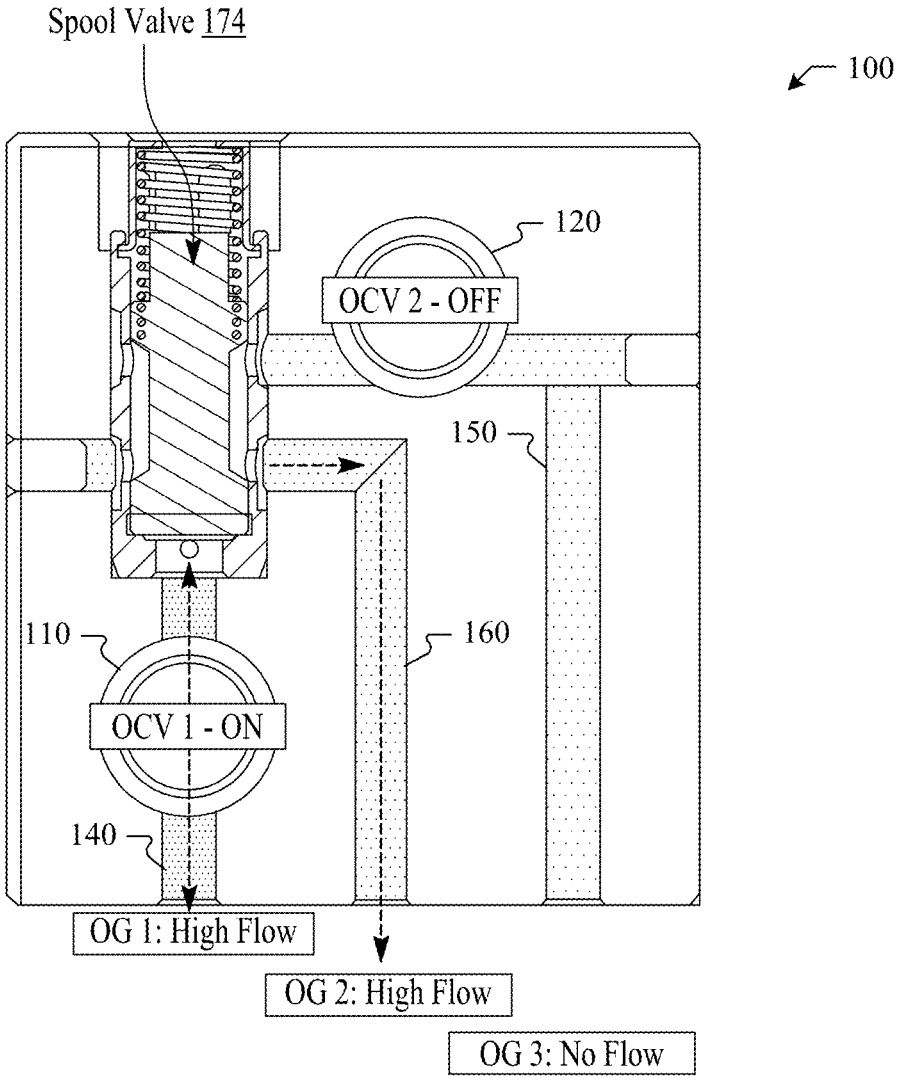
FIG. 5 illustrates a schematic partial sectional top view of the oil control circuit operating in a third mode.

FIG. 5 illustrates a schematic partial sectional top view of the oil control circuit 100 operating in a third mode. From the default status (i.e., the first mode), the first oil control valve 110 may be activated. The activation of the first oil control valve 110 may bring oil to the first oil gallery 140. Subsequently, the raise of oil pressure from the first oil gallery 140 may cause the spool valve 174 to slide axially, opening the connection between the first oil gallery 140 and the third oil gallery 160. In view of the illustration of FIG. 5, the spool valve 174 may be moved upward, putting in communication between the first oil gallery 140 with the third oil gallery 160 and plugging the second oil gallery 150. As a result, the oil from the first oil gallery 140 may be permitted to flow also in the third oil gallery 160. The second oil gallery 150 may maintain the default pressure without any oil flow.

Figure 6:
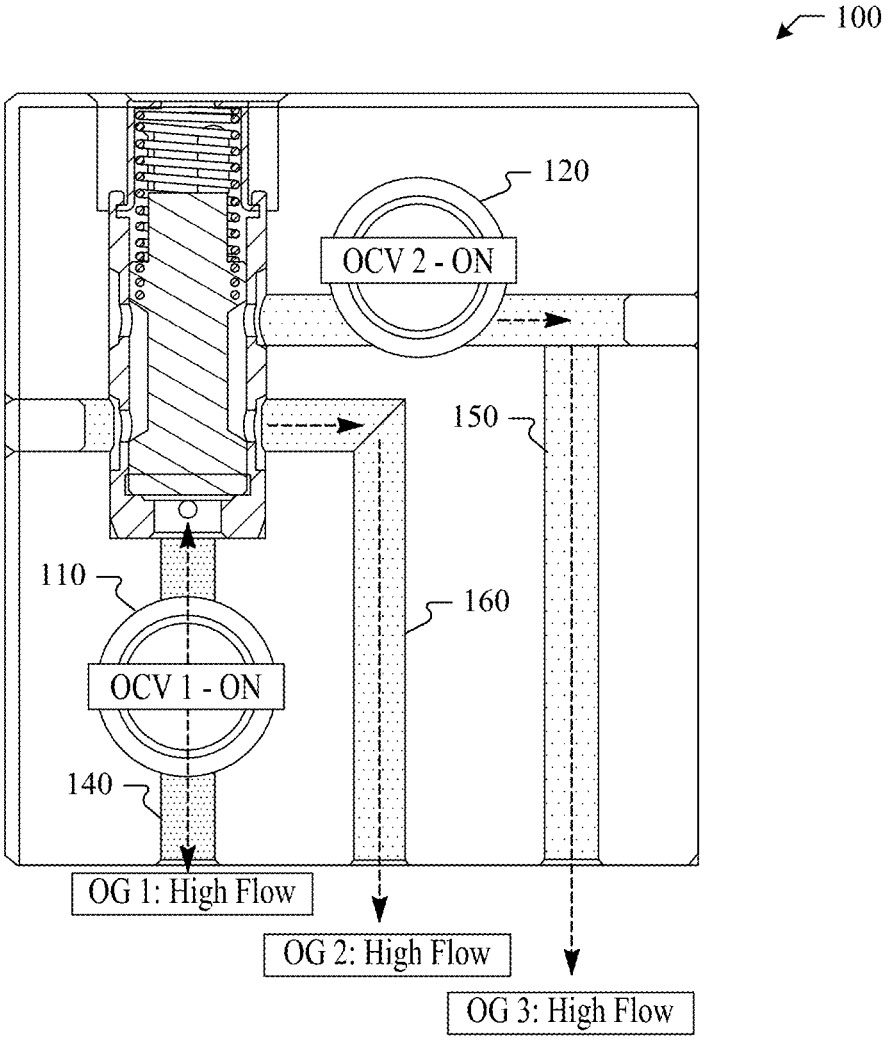
FIG. 6 illustrates a schematic partial sectional top view of the oil control circuit operating in a fourth mode.

FIG. 6 illustrates a schematic partial sectional top view of the oil control circuit 100 operating in a fourth mode. In particular embodiments, the fourth mode may be reached by any of the previous modes (i.e., the first, second, and third modes). In particular embodiments, both the first oil control valve 110 and the second oil control valve 120 may be active, so oil flow is passing on all three oil galleries. In particular embodiments, the spool valve 174 may be moved upward, putting in communication between the first oil gallery 140 with the third oil gallery 160 and plugging the second oil gallery 150.

Figure 7A:
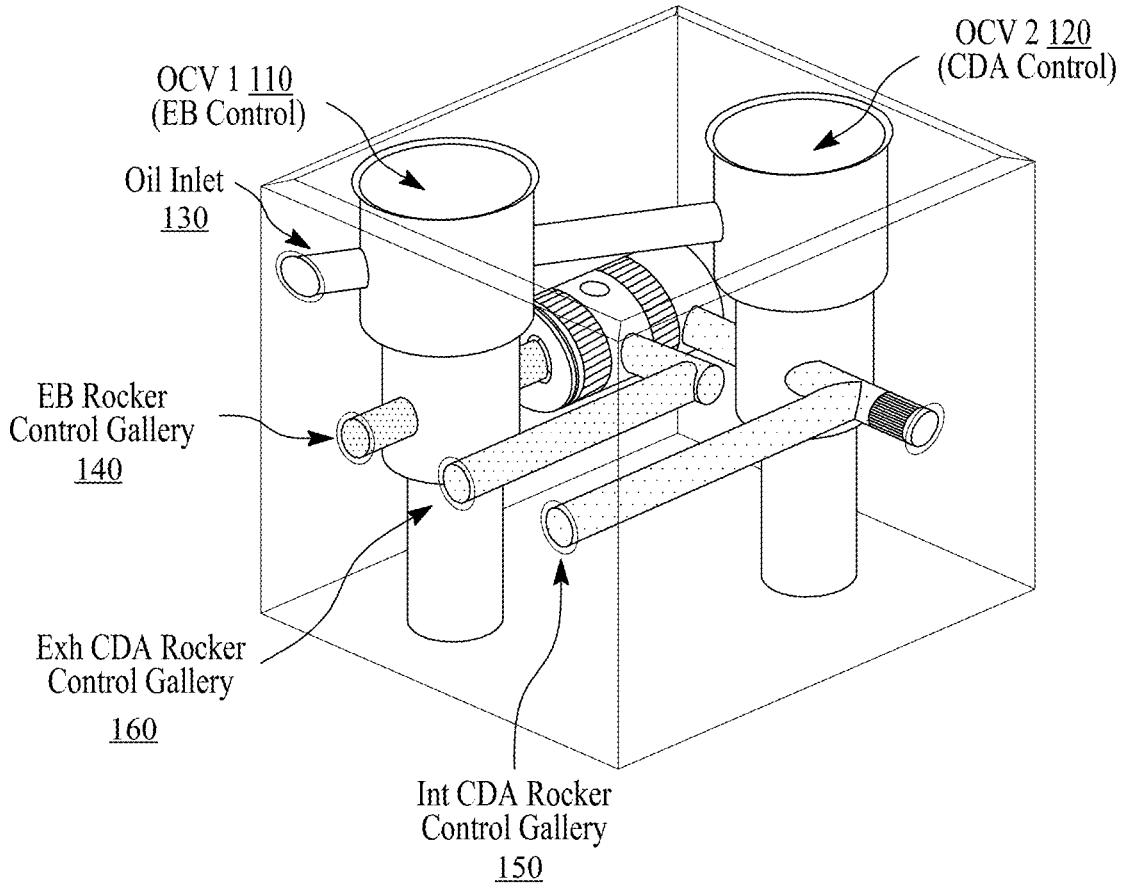
FIG. 7A illustrates a schematic perspective view of the oil control circuit for control of 1.5 stroke engine brake and cylinder deactivation (CDA).
Figure 7B:
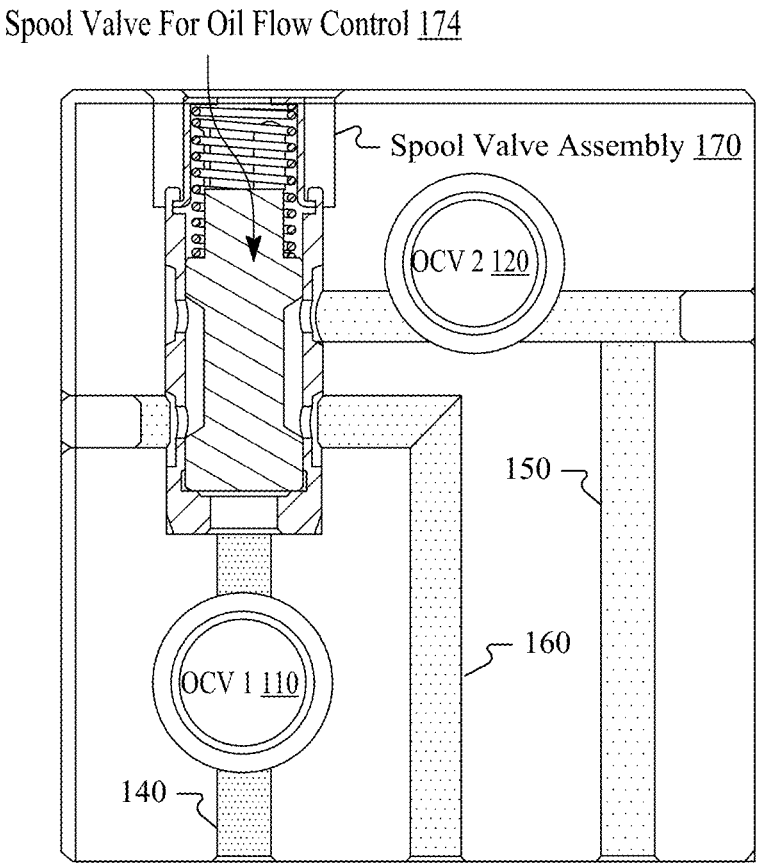
FIG. 7B illustrates a schematic partial sectional top view of the oil control circuit for control of 1.5 stroke engine brake and cylinder deactivation (CDA).

FIG. 7A illustrates a schematic perspective view of the oil control circuit for control of 1.5 stroke engine brake and cylinder deactivation (CDA). In particular embodiments, the oil control circuit 100 may be compatible with control system for valve train integrating 1.5 stroke engine brake and cylinder deactivation. In particular embodiments, 1.5 stroke engine brake may require the activation of the engine brake function and the contemporary valve deactivation of the only exhaust valves, while CDA mode may require deactivation of both intake and exhaust valves. In particular embodiments, the first oil control valve 110 may be for engine brake control whereas the second oil control valve 120 may be for CDA control. The first oil gallery 140 may be a control gallery for engine brake rocker. The second oil gallery 150 may be a control gallery for exhaust CDA rocker. The third oil gallery 160 may be a control gallery for intake CDA rocker. FIG. 7B illustrates a schematic partial sectional top view of the oil control circuit for control of 1.5 stroke engine brake and cylinder deactivation (CDA). As may be seen, the spool valve 174 may be used for oil flow control.

Figure 8:
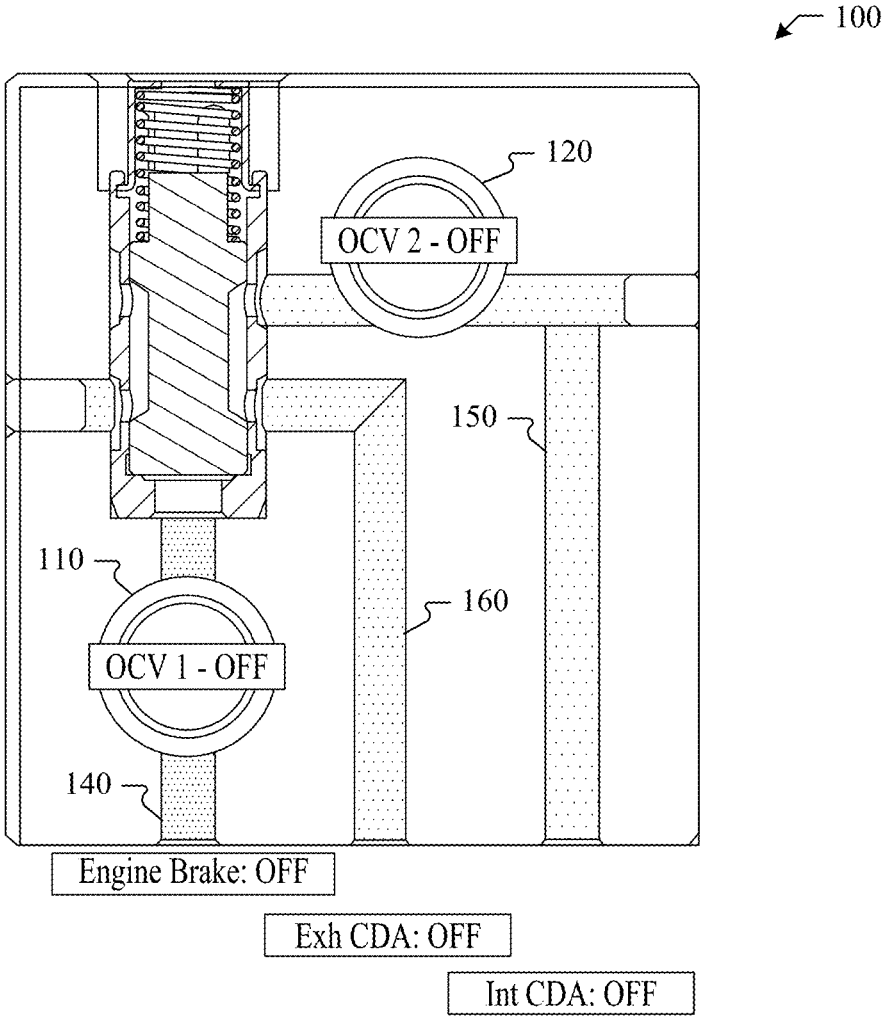
FIG. 8 illustrates a schematic partial sectional top view of the oil control circuit operating in a drive mode.

In particular embodiments, the first mode may be associated with the drive mode. FIG. 8 illustrates a schematic partial sectional top view of the oil control circuit 100 operating in a drive mode. In the drive mode, the first oil control valve 110 (for engine brake control) and the second oil control valve 120 (for CDA control) may be both off. There may be no oil flow passing. The second oil gallery 150 and the third oil gallery 160 may be connected through the spool valve balancing pressure between the two galleries. In particular embodiments, the engine brake, the exhaust CDA valve, and intake CDA valve may be all off.

Figure 9:
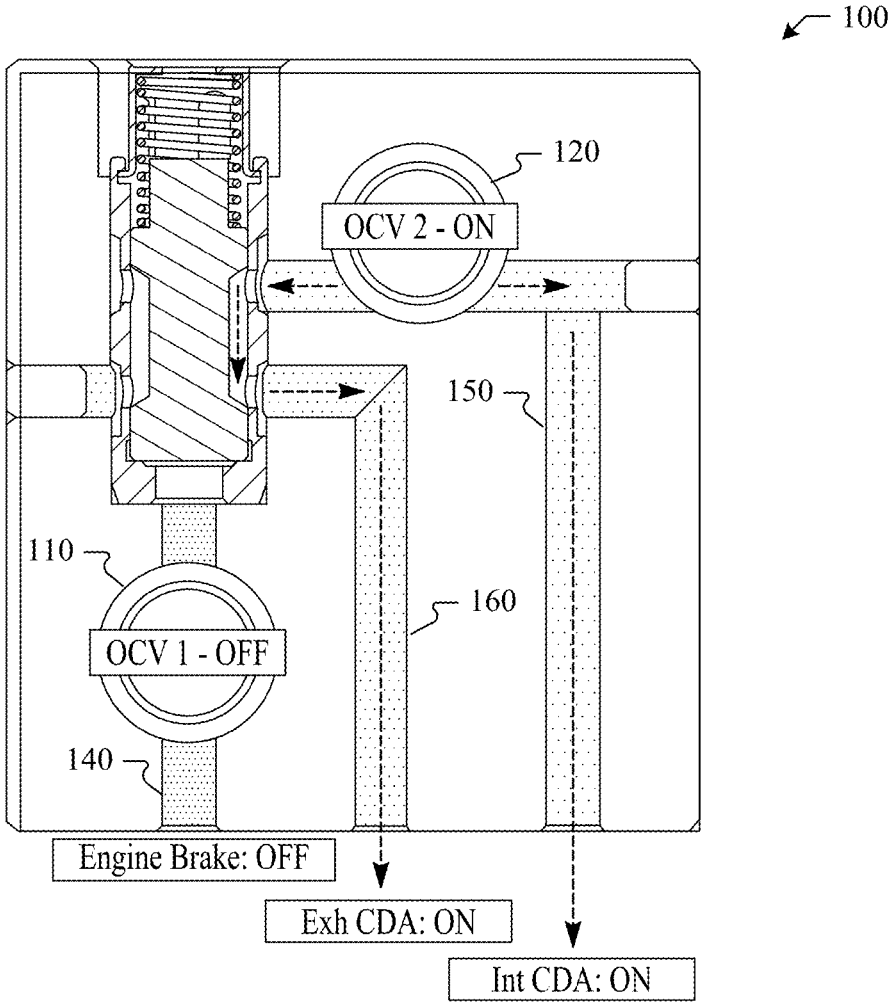
FIG. 9 illustrates a schematic partial sectional top view of the oil control circuit operating in a CDA mode.

In particular embodiments, the second mode may be associated with the CDA mode. FIG. 9 illustrates a schematic partial sectional top view of the oil control circuit 100 operating in a CDA mode. From the drive mode, the second oil control valve 120 (for CDA control) may be activated. The activation of the second oil control valve 120 may bring oil to the second oil gallery 150 and the third oil gallery 160 that are already in connection. In particular embodiments, the engine brake may be off. The exhaust CDA valve and intake CDA valve may be both on.

Figure 10:
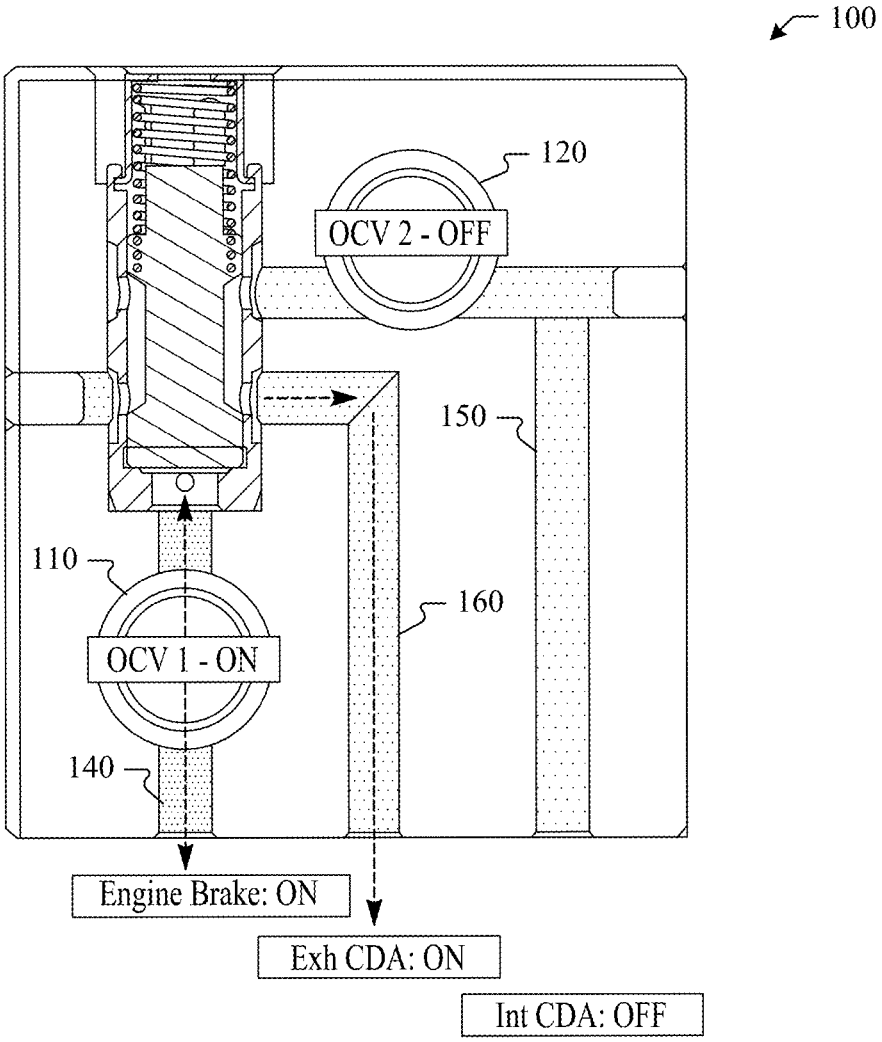
FIG. 10 illustrates a schematic partial sectional top view of the oil control circuit operating in a 1.5 stroke engine.

In particular embodiments, the third mode may be associated with the 1.5 stroke engine brake. FIG. 10 illustrates a schematic partial sectional top view of the oil control circuit 100 operating in a 1.5 stroke engine. From the drive mode, the first oil control valve 110 (for engine brake control) may be activated. The activation of the first oil control valve 110 may bring oil to the first oil gallery 140. Subsequently, the raise of oil pressure from the first oil gallery 140 may cause the spool valve 174 to slide axially, opening the connection between the first oil gallery 140 and the third oil gallery 160. In view of the illustration of FIG. 10, the spool valve 174 may be moved upward, putting in communication between the first oil gallery 140 with the third oil gallery 160 and plugging the second oil gallery 150. As a result, the oil from the first oil gallery 140 may be permitted to flow also in the third oil gallery 160. The second oil gallery 150 may maintain the default pressure without any oil flow. In particular embodiments, the engine brake may be on. The exhaust CDA valve may be on whereas the intake CDA valve may be off.

Figure 11:
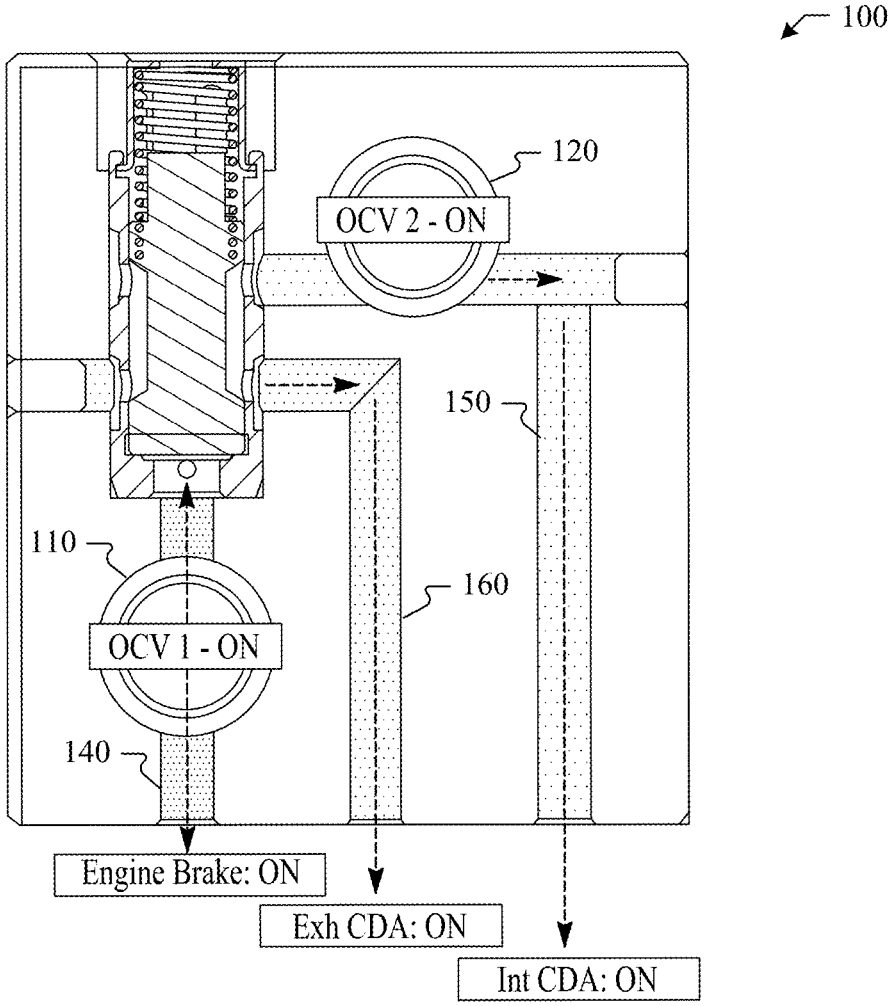
FIG. 11 illustrates a schematic partial sectional top view of the oil control circuit operating in an all-active mode.

In particular embodiments, the third mode may be associated with the all-active mode. The all-active mode may help expand the functionality. FIG. 11 illustrates a schematic partial sectional top view of the oil control circuit 100 operating in an all-active mode. In particular embodiments, the all-active mode may be reached by any of the previous modes (i.e., the drive mode, the CDA mode, and the 1.5 stroke engine brake). In particular embodiments, both the first oil control valve 110 (for engine brake control) and the second oil control valve 120 (for CDA control) may be active, so oil flow is passing on all three oil galleries. In particular embodiments, the engine brake, the exhaust CDA valve, and intake CDA valve may be all on. In particular embodiments, the spool valve 174 may be moved upward, putting in communication between the first oil gallery 140 with the third oil gallery 160 and plugging the second oil gallery 150.

Figure 12:
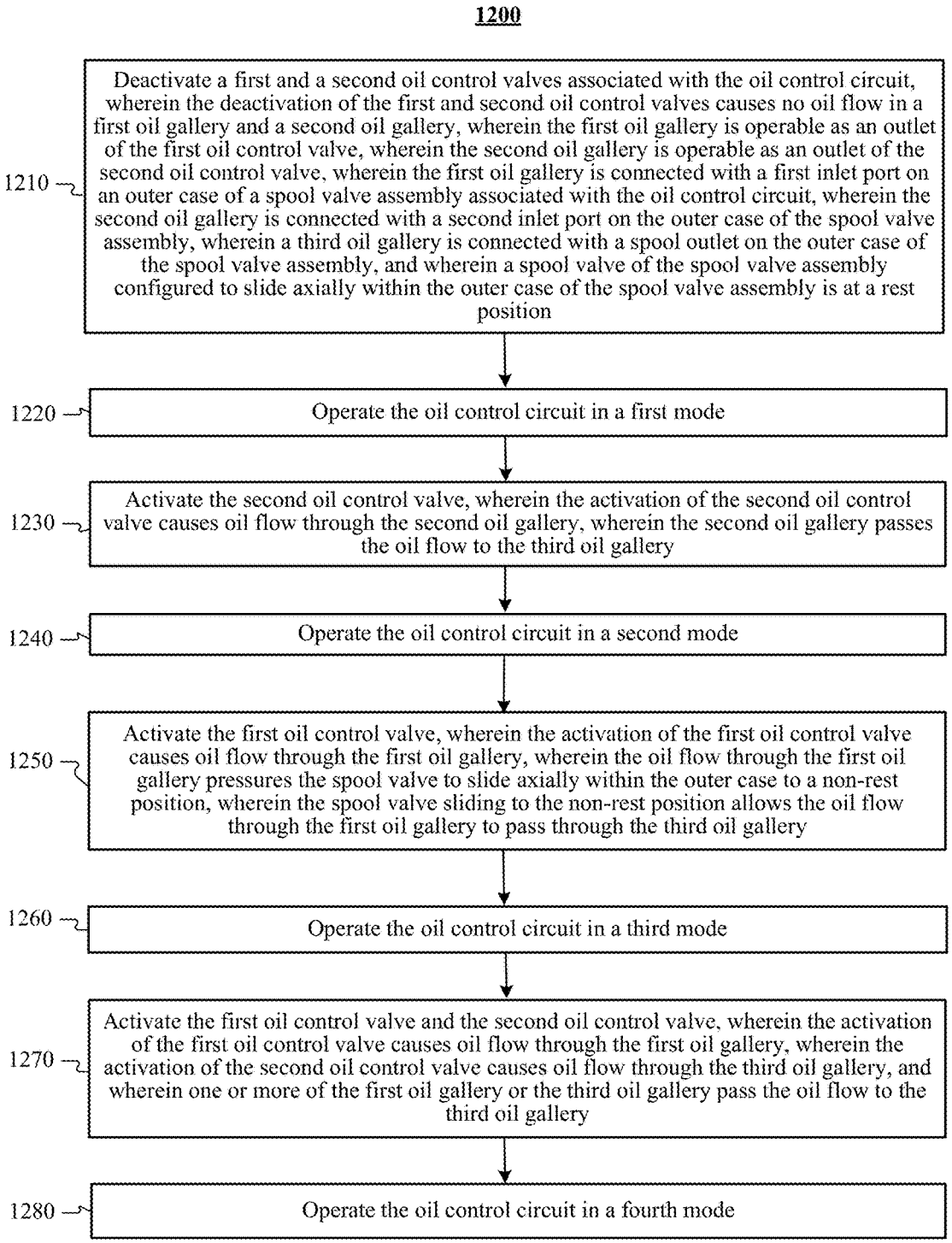
FIG. 12 illustrates a flowchart of an example method for switching operations of an oil control circuit among a plurality of oil controlled variable valve lift modes.

FIG. 12 illustrates a flowchart 1200 of an example method for switching operations of an oil control circuit among a plurality of oil controlled variable valve lift modes. At step 1210, the oil control circuit may deactivate a first and a second oil control valves associated with the oil control circuit, wherein the deactivation of the first and second oil control valves causes no oil flow in a first oil gallery and a second oil gallery, wherein the first oil gallery is operable as an outlet of the first oil control valve, wherein the second oil gallery is operable as an outlet of the second oil control valve, wherein the first oil gallery is connected with a first inlet port on an outer case of a spool valve assembly associated with the oil control circuit, wherein the second oil gallery is connected with a second inlet port on the outer case of the spool valve assembly, wherein a third oil gallery is connected with a spool outlet on the outer case of the spool valve assembly, and wherein a spool valve of the spool valve assembly configured to slide axially within the outer case of the spool valve assembly is at a rest position. At step 1220, the oil control circuit may operate the oil control circuit in a first mode.

At step 1230, the oil control circuit may activate the second oil control valve, wherein the activation of the second oil control valve causes oil flow through the second oil gallery, wherein the second oil gallery passes the oil flow to the third oil gallery. At step 1240, the oil control circuit may operate the oil control circuit in a second mode.

At step 1250, the oil control circuit may activate the first oil control valve, wherein the activation of the first oil control valve causes oil flow through the first oil gallery, wherein the oil flow through the first oil gallery pressures the spool valve to slide axially within the outer case to a non-rest position, wherein the spool valve sliding to the non-rest position allows the oil flow through the first oil gallery to pass through the third oil gallery. At step 1260, the oil control circuit may operate the oil control circuit in a third mode.

At step 1270, the oil control circuit may activate the first oil control valve and the second oil control valve, wherein the activation of the first oil control valve causes oil flow through the first oil gallery, wherein the activation of the second oil control valve causes oil flow through the third oil gallery, and wherein one or more of the first oil gallery or the third oil gallery pass the oil flow to the third oil gallery. At step 180, the oil control circuit may operate the oil control circuit in a fourth mode.

Particular embodiments may repeat one or more steps of the method of FIG. 12, where appropriate. Although this disclosure describes and illustrates particular steps of the method of FIG. 12 as occurring in a particular order, this disclosure contemplates any suitable steps of the method of FIG. 12 occurring in any suitable order. Moreover, although this disclosure describes and illustrates an example method for switching operations of an oil control circuit among a plurality of oil controlled variable valve lift modes including the particular steps of the method of FIG. 12, this disclosure contemplates any suitable method for switching operations of an oil control circuit among a plurality of oil controlled variable valve lift modes including any suitable steps, which may include all, some, or none of the steps of the method of FIG. 12, where appropriate. Furthermore, although this disclosure describes and illustrates particular components, mechanisms, or assemblies carrying out particular steps of the method of FIG. 12, this disclosure contemplates any suitable combination of any suitable components, mechanisms, or assemblies carrying out any suitable steps of the method of FIG. 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. A longitudinal axis of the upper and lower crowns, which may have been omitted in some illustrations for convenience of scale, should be construed to exist in every illustration or situation where it is referred to.

What is claimed is:

1. A spool valve assembly operable for an automatic control of an oil flow, the spool valve assembly comprising:

an outer case comprising a first surface, a second surface on an opposite end of the first surface, and a lateral surface between the first surface and the second surface;

a spool valve configured to slide axially between the first surface and the second surface within the outer case;

a return spring adjacent to the first surface, the return spring being configured to cause the spool valve to return to a rest position;

a first inlet port on the outer case configured for connecting with a first oil gallery, wherein the first oil gallery is operable as an outlet of a first oil control valve, and wherein the first inlet port is on the second surface of the outer case such that an oil flow through the first oil gallery into the first inlet port pressures the return spring to open to cause the spool valve to slide axially within the outer case to a non-rest position along a direction towards the first surface from the second surface;

a second inlet port on the lateral surface of the outer case configured for connecting with a second oil gallery, wherein the second oil gallery is operable as an outlet of a second oil control valve; and a spool outlet on the outer case configured for connecting with a third oil gallery.

2. A method for switching operations of an oil control circuit among a plurality of oil controlled variable valve lift modes, comprising:

deactivating a first and a second oil control valves associated with the oil control circuit, wherein the deactivation of the first and second oil control valves causes no oil flow in a first oil gallery and a second oil gallery, wherein the first oil gallery is operable as an outlet of the first oil control valve, wherein the second oil gallery is operable as an outlet of the second oil control valve, wherein the first oil gallery is connected with a first inlet port on an outer case of a spool valve assembly associated with the oil control circuit, wherein the second oil gallery is connected with a second inlet port on the outer case of the spool valve assembly, wherein a third oil gallery is connected with a spool outlet on the outer case of the spool valve assembly, and wherein a spool valve of the spool valve assembly configured to slide axially within the outer case of the spool valve assembly is at a rest position; and operating the oil control circuit in a first mode.

3. The method of claim 2, wherein oil flow is passable between the second oil gallery and the third oil gallery based on balancing pressure associated with the spool valve assembly between the second and third oil galleries.

4. The method of claim 2, wherein the first mode is a drive mode, wherein the oil control circuit is associated with an engine brake, wherein the engine brake is off, wherein the oil control circuit is associated with an exhaust valve for cylinder deactivation, wherein the exhaust valve is off, wherein the oil control circuit is associated with an intake valve for cylinder deactivation, and wherein the intake valve is off.

5. The method of claim 2, further comprising:

activating the second oil control valve, wherein the activation of the second oil control valve causes oil flow through the second oil gallery, wherein the second oil gallery passes the oil flow to the third oil gallery; and operating the oil control circuit in a second mode.

6. The method of claim 5, wherein the second mode is a cylinder deactivation (CDA) mode, wherein the oil control circuit is associated with an engine brake, wherein the engine brake is off, wherein the oil control circuit is associated with an exhaust valve for cylinder deactivation, wherein the exhaust valve is on, wherein the oil control circuit is associated with an intake valve for cylinder deactivation, and wherein the intake valve is on.

7. The method of claim 2, further comprising:

activating the first oil control valve, wherein the activation of the first oil control valve causes oil flow through the first oil gallery, wherein the oil flow through the first oil gallery pressures the spool valve to slide axially within the outer case to a non-rest position, wherein the spool valve sliding to the non-rest position allows the oil flow through the first oil gallery to pass through the third oil gallery; and operating the oil control circuit in a third mode.

8. The method of claim 7, wherein the third mode is an engine brake mode, wherein the oil control circuit is associated with an engine brake, wherein the engine brake is on, wherein the oil control circuit is associated with an exhaust valve for cylinder deactivation, wherein the exhaust valve is on, wherein the oil control circuit is associated with an intake valve for cylinder deactivation, and wherein the intake valve is off.

9. The method of claim 2, further comprising:

activating the first oil control valve and the second oil control valve, wherein the activation of the first oil control valve causes oil flow through the first oil gallery, wherein the activation of the second oil control valve causes oil flow through the third oil gallery, and wherein one or more of the first oil gallery or the third oil gallery pass the oil flow to the third oil gallery; and operating the oil control circuit in a fourth mode.

10. The method of claim 9, wherein the fourth mode is an all-active mode, wherein the oil control circuit is associated with an engine brake, wherein the engine brake is on, wherein the oil control circuit is associated with an exhaust valve for cylinder deactivation, wherein the exhaust valve is on, wherein the oil control circuit is associated with an intake valve for cylinder deactivation, and wherein the intake valve is on.

11. An oil control circuit configured for switching among a plurality of oil controlled variable valve lift modes, comprising:

a first oil control valve;

a second oil control valve;

a first oil gallery operable as an outlet of the first oil control valve;

a second oil gallery operable as an outlet of the second oil control valve;

a third oil gallery; and a spool valve assembly comprising:

an outer case;

a spool valve configured to slide axially within the outer case;

a first inlet port on the outer case configured for connecting with the first oil gallery;

a second inlet port on the outer case configured for connecting with the second oil gallery;

a spool outlet on the outer case configured for connecting with the third oil gallery; and a return spring configured to cause the spool valve to return to a rest position.

12. The oil control circuit of claim 11, wherein the oil control circuit is configured for:

deactivating the first and the second oil control valves, wherein the deactivation of the first and second oil control valves causes no oil flow in the first oil gallery and the second oil gallery; and operating in a first mode.

13. The oil control circuit of claim 12, wherein oil flow is passable between the second oil gallery and the third oil gallery based on balancing pressure associated with the spool valve assembly between the second and third oil galleries.

14. The oil control circuit of claim 12, wherein the first mode is a drive mode, wherein the oil control circuit is associated with an engine brake, wherein the engine brake is off, wherein the oil control circuit is associated with an exhaust valve for cylinder deactivation, wherein the exhaust valve is off, wherein the oil control circuit is associated with an intake valve for cylinder deactivation, and wherein the intake valve is off.

15. The oil control circuit of claim 11, wherein the oil control circuit is configured for:

deactivating the first oil control valve, wherein the deactivation of the first oil control valve causes no oil flow in the first oil gallery;

activating the second oil control valve, wherein the activation of the second oil control valve causes oil flow through the second oil gallery, wherein the second oil gallery passes the oil flow to the third oil gallery; and operating in a second mode.

16. The oil control circuit of claim 15, wherein the second mode is a cylinder deactivation (CDA) mode, wherein the oil control circuit is associated with an engine brake, wherein the engine brake is off, wherein the oil control circuit is associated with an exhaust valve for cylinder deactivation, wherein the exhaust valve is on, wherein the oil control circuit is associated with an intake valve for cylinder deactivation, and wherein the intake valve is on.

17. The oil control circuit of claim 11, wherein the oil control circuit is configured for:

activating the first oil control valve, wherein the activation of the first oil control valve causes oil flow through the first oil gallery, wherein the oil flow through the first oil gallery pressures the spool valve to slide axially within the outer case to a non-rest position, wherein the spool valve sliding to the non-rest position allows the oil flow through the first oil gallery to pass through the third oil gallery;

deactivating the second oil control valve, wherein the deactivation of the second oil control valve causes no oil flow in the second oil gallery; and operating in a third mode.

18. The oil control circuit of claim 17, wherein the third mode is an engine brake mode, wherein the oil control circuit is associated with an engine brake, wherein the engine brake is on, wherein the oil control circuit is associated with an exhaust valve for cylinder deactivation, wherein the exhaust valve is on, wherein the oil control circuit is associated with an intake valve for cylinder deactivation, and wherein the intake valve is off.

19. The oil control circuit of claim 11, wherein the oil control circuit is configured for:

activating the first oil control valve and the second oil control valve, wherein the activation of the first oil control valve causes oil flow through the first oil gallery, wherein the activation of the second oil control valve causes oil flow through the third oil gallery, and wherein one or more of the first oil gallery or the third oil gallery pass the oil flow to the third oil gallery; and operating in a fourth mode.

20. The oil control circuit of claim 19, wherein the fourth mode is an all-active mode, wherein the oil control circuit is associated with an engine brake, wherein the engine brake is on, wherein the oil control circuit is associated with an exhaust valve for cylinder deactivation, wherein the exhaust valve is on, wherein the oil control circuit is associated with an intake valve for cylinder deactivation, and wherein the intake valve is on.

* * * * *